US011655578B2

(12) United States Patent
Bensmann et al.

(10) Patent No.: US 11,655,578 B2
(45) Date of Patent: May 23, 2023

(54) METHOD OF OPERATING A WASHING MACHINE AND WASHING MACHINE

(71) Applicant: Miele & Cie. KG, Gütersloh (DE)

(72) Inventors: Annette Bensmann, Georgsmarienhütte (DE); Dirk Sieding, Lünen (DE); Marcel Zielke, Ennigerloh (DE)

(73) Assignee: MIELE & CIE. KG, Gütersloh (DE)

( * ) Notice: Subject to any disclaimer, the term of this patent is extended or adjusted under 35 U.S.C. 154(b) by 0 days.

(21) Appl. No.: 16/977,515

(22) PCT Filed: Feb. 26, 2019

(86) PCT No.: PCT/EP2019/054692
§ 371 (c)(1),
(2) Date: Sep. 2, 2020

(87) PCT Pub. No.: WO2019/174905
PCT Pub. Date: Sep. 19, 2019

(65) Prior Publication Data

US 2021/0002806 A1 Jan. 7, 2021

(30) Foreign Application Priority Data

Mar. 12, 2018 (DE) ..... 10 2018 105 667.2

(51) Int. Cl.
*D06F 35/00* (2006.01)
*D06F 39/14* (2006.01)
(Continued)

(52) U.S. Cl.
CPC ..... *D06F 35/008* (2013.01); *D06F 39/088* (2013.01); *D06F 39/14* (2013.01);
(Continued)

(58) Field of Classification Search
CPC ..... D06F 35/008; D06F 2103/20; D06F 2103/04; D06F 2105/52; D06F 39/088; D06F 39/14
(Continued)

(56) References Cited

U.S. PATENT DOCUMENTS 4,987,627 A * 1/1991 Cur ..... D06F 39/081 8/158
2017/0241060 A1* 8/2017 Seong ..... D06F 23/06
2017/0356115 A1* 12/2017 Choi ..... D06F 37/36

FOREIGN PATENT DOCUMENTS

CN 107604585 A 1/2018
DE 4104151 A1 8/1992
(Continued)

OTHER PUBLICATIONS

CN107604585A—machine translation (Year: 2018).*
(Continued)

*Primary Examiner* — Tinsae B Ayalew
(74) *Attorney, Agent, or Firm* — Dickinson Wright PLLC

(57) ABSTRACT

A washing machine has a suds container arranged in a housing, in which container a drum is rotatably mounted, a loading opening arranged on the front of the housing which can be closed by a door having a door inspection glass, a door sealing ring that extends between the housing and the suds container around the loading opening, and a control or regulating device. The washing machine is configured for carrying out a selected washing program including a rinsing phase and a step, in which water is applied to the door inspection glass and the door sealing ring following the rinsing phase to rinse the door inspection glass and the door sealing ring. The washing machine performs a spin cycle after the rinsing phase and before applying water to the door
(Continued)

inspection glass and the door sealing ring at a maximum speed as a function of the selected washing program.

10 Claims, 2 Drawing Sheets

(51) Int. Cl.

| | |
|---|---|
| *D06F 103/04* | (2020.01) |
| *D06F 103/20* | (2020.01) |
| *D06F 105/52* | (2020.01) |
| *D06F 39/08* | (2006.01) |

(52) U.S. Cl.
CPC ..... *D06F 2103/04* (2020.02); *D06F 2103/20* (2020.02); *D06F 2105/52* (2020.02)

(58) Field of Classification Search
USPC ..... 8/159
See application file for complete search history.

(56) References Cited

FOREIGN PATENT DOCUMENTS

| | | | |
|---|---|---|---|
| DE | 19731667 | A1 | 1/1999 |
| DE | 19839896 | A1 | 3/2000 |
| EP | 2112262 | A1 | 10/2009 |
| EP | 2796607 | A1 | 10/2014 |
| EP | 3192914 | A1 | 7/2017 |
| JP | 2013085850 | A | 5/2013 |

OTHER PUBLICATIONS

JP2013085850A—machine translation (Year: 2013).*
European Patent Office, Rijswijk, Netherlands, International Search Report of International Application No. PCT/EP2019/054692, dated Apr. 16, 2019, 2 pages.

* cited by examiner

METHOD OF OPERATING A WASHING MACHINE AND WASHING MACHINE

TECHNICAL FIELD

The invention relates to a method for operating a washing machine and to a washing machine. In particular, the invention relates to a method for operating a washing machine having a suds container arranged in a housing, in which container a drum is rotatably mounted, a loading opening arranged at the front of the housing which can be closed by means of a door having a door inspection glass, and a door sealing ring that extends between the housing and the suds container around the loading opening, and a control or regulating device, as well as a correspondingly formed washing machine.

BACKGROUND

The method comprises carrying out a selected washing program that comprises a rinsing phase, and water being applied to the door inspection glass and the door sealing ring following the rinsing phase in order to rinse the door inspection glass and the door sealing ring. Such a method is known from EP3192914A1. This is intended to rinse away foam from the door inspection glass or in the inner drum. However, it has been shown that the method is only effective for washing programs with low load amounts.

SUMMARY

The invention therefore provides a method and a washing machine with which foam can be rinsed away in front of the door inspection glass and/or in the inner drum, regardless of a load amount of a washing program.

In addition to eliminating foam from the door inspection glass and/or in the inner drum, the advantages which can be achieved with the invention are that the foam is removed regardless of a load amount of a washing program. If necessary, the spin cycle is carried out at maximum speed to remove any laundry from the door inspection glass. Visible foam and foam on and in the door sealing ring are subsequently dissolved and rinsed away or, if the spin cycle is not necessary, only by applying water to the door inspection glass and the door sealing ring on the door inspection glass.

According to the invention, the following step is provided in the method: Carrying out a spin cycle after the rinsing phase and before applying the water to the door inspection glass and the door sealing ring at a maximum speed as a function of the selected washing program.

The step according to the invention displaces the laundry, as a function of the selected washing program, from the area of the door inspection glass and the door sealing ring, so that the water applied to the door inspection glass and the door sealing ring can touch the foam and is not sucked up by the laundry in the drum.

In a preferred embodiment, the method has the following steps: Determining whether the washing program has a threshold load amount that exceeds a predetermined maximum load amount and/or is a voluminous laundry washing program, and carrying out the spin cycle after the rinsing phase and before the water is applied to the door inspection glass and the door sealing ring at a maximum rotational speed as a function of whether the washing program has the threshold load amount that exceeds the predetermined maximum load amount and/or is the voluminous laundry washing program.

In a preferred embodiment, the predetermined maximum load amount is a load amount of 2 kg. The maximum speed is preferably 600 rpm, more preferably 550 rpm. It has been found that performing the maximum speed spin cycle is only necessary if the washing program has a threshold load amount that exceeds the predetermined maximum load amount and/or is a voluminous laundry washing program. A voluminous laundry washing program is a washing program for washing voluminous laundry such as pillows, down, and/or terry towels.

In a preferred embodiment, when it is determined that the washing program has a threshold load amount that is equal to or less than the predetermined maximum load amount and is a washing program that is different from the voluminous laundry washing program, water is poured onto the door inspection glass directly after the rinsing phase and/or applied the door sealing ring, in order to rinse the door inspection glass and the door sealing ring. That is, if the washing program has the threshold load amount that is less than or equal to the predetermined maximum load amount and is a washing program that is different from the voluminous laundry washing program, the spin cycle is not carried out at the maximum rotational speed, but rather water is applied to the door inspection glass and the door sealing ring immediately after the rinsing phase, in order to rinse them and thus free them of foam. For the purposes of the invention, the threshold load amount is a maximum permissible load amount for each individual washing program. The threshold load quantity can vary from wash program to wash program and is assigned to each washing program in the washing machine.

When determining that the washing program has a threshold load amount that exceeds the predetermined maximum loading amount and/or is the voluminous laundry washing program, it is preferred that the spin cycle is carried out at the maximum rotational speed, and water is subsequently applied to the door inspection glass and/or the door sealing ring in order to rinse the door inspection glass and the door sealing ring. This means that, if the washing program has a threshold load amount that exceeds the predetermined maximum load amount and/or is a voluminous laundry washing program, the spin cycle is carried out at the maximum speed between the rinsing phase and the application of water to the door inspection glass and the door sealing ring. The purpose of the spin cycle after the rinsing phase and before applying the water to the door inspection glass and the door sealing ring at a maximum speed is to displace the laundry from the door inspection glass as far as possible and to expose the foam, which usually does not change due to the spinning. After exposing the foam, the door inspection glass and the door sealing ring are rinsed by applying water.

The door inspection glass and the door sealing ring are rinsed with water so that the foam that accumulates there is rinsed away without the need for additional agents. Rather, existing components of the washing machine can be used to remove the foam from the door inspection glass and the door sealing ring. The application of water preferably comprises spraying at least a part of the door inspection glass and the door sealing ring. The water can be applied at one or more points on the door inspection glass and the door sealing ring. In a preferred embodiment, the water is applied to the door inspection glass and the door sealing ring via a door inspection glass flusher. This allows the water to be applied directly to the door inspection glass or the door sealing ring. For example, the door inspection glass flusher has a nozzle that sprays the water onto the door inspection glass and the door sealing ring.

In this regard, when the spin cycle is carried out, the method is preferably carried out as follows: The method preferably has the following steps: sensing a load amount of laundry in the drum in an initial phase of the washing program and linear or step-by-step adjustment of the maximum rotational speed during the spin cycle as a function of the sensed load amount. Alternatively or additionally, the method has the following steps: sensing foam in the drum at the end and/or after the rinsing phase and linear or step-by-step adjustment of the maximum rotational speed during the spin cycle as a function of the foam sensing. This means that the spinning process can be regulated and/or controlled depending on the sensed load and/or sensed foam. With a relatively low sensed load, the maximum speed of the spinning process is preferably set linearly. In the case of a relatively high sensed load and/or sensed foam, the speed of the spin cycle is preferably gradually increased to the maximum rotational speed of the spin cycle. The maximum speed is preferably 600 rpm, more preferably 550 rpm. At this maximum rotational speed, more foam is avoided and the laundry is pressed against the drum wall, but does not collapse again when the drum stops. A foam sensor is known, for example, from DE19839896A1 or DE4104151A1.

The drum is preferably at a standstill while the water is being applied to the door inspection glass and/or the door sealing ring in order to rinse the door inspection glass and the door sealing ring. In a preferred embodiment, a speed of rotation of the drum during the application of the water to the door inspection glass and the door sealing ring is therefore 0 rpm. This means that the drum is not rotated while water is being applied to the door inspection glass and the door sealing ring. This allows the water applied to take the foam with it towards the drain.

In a preferred embodiment, a drain device for conducting the water out of the tub is permanently activated following the rinsing phase during the spin cycle at the maximum rotational speed and/or during the application of water to the door inspection glass and the door sealing ring. The water and foam are thereby removed from the tub and cannot contaminate the laundry.

Alternatively, preferably following the rinsing phase during the spin cycle at the maximum rotational speed and/or during the application of water to the door inspection glass and the door sealing ring, the drain device for conducting the water out of the suds container is activated when a pressure in the tub is sensed which is greater than a predetermined threshold. The predetermined threshold value is preferably selected such that the sensed pressure is not higher than a water level which is at a lower edge of the drum. This is to prevent the foam from rising again into an area visible to a user of the washing machine, such as the door inspection glass.

In a preferred embodiment, an amount of water that is applied to the door inspection glass and the door sealing ring in order to rinse the door inspection glass and the door sealing ring corresponds to a predetermined amount of water which is a function of the washing program carried out. This may be necessary if a certain total amount of water in the washing program should not be exceeded. Alternatively or additionally, an amount of water that is applied to the door inspection glass and the door sealing ring in order to rinse the door inspection glass and the door sealing ring is a function of the sensed load amount, the sensed foam, and/or an amount of an automatically metered detergent that is supplied to the suds container during the washing program. The amount of water applied to the door inspection glass and the door sealing ring is therefore adapted to the washing process, to an actual amount of foam, and/or to an automatic detergent dosage. This ensures that the foam can actually be washed away and an optimal amount of water is used, i.e., neither too much nor too little water is used for rinsing.

The selected washing program preferably has the following sequence: First, the load amount is determined in a detection phase using a mass inertia method or a weight measurement. A washing phase is then carried out with supplying water and optionally detergent into the suds container, heating the water to a predetermined washing temperature, washing the laundry, and pumping the water out of the suds container by means of the drain device. A rinsing phase is then carried out with one rinsing segment or a plurality of rinsing segments, each comprising feeding water into the suds container, and pumping the water out of the suds container using the drain device. The spin cycle is then carried out at the maximum rotational speed as a function of the selected washing program. Then water is applied to the door inspection glass and the door sealing ring to rinse them. A final spin cycle is then carried out with the laundry being spun until it is placed on the drum wall, with water being pumped out of the suds container using the drain device.

The invention further relates to a washing machine having a suds container arranged in a housing, in which container a drum is rotatably mounted, a loading opening arranged at the front of the housing which can be closed by means of a door having a door inspection glass, a door sealing ring which extends between the housing and the suds container around the loading opening, and a control or regulating device that is designed to control or regulate a method according to one or a plurality of the described embodiments.

Furthermore, the washing machine preferably has a door inspection glass flusher. The door inspection glass flusher is preferably provided in and/or on the door sealing ring. For example, the door inspection glass flusher is an injection device such as a nozzle and/or an opening in a door sealing ring designed as a bellows seal or as an elastic sleeve.

The washing machine can be a washing machine used in a private household or commercially. The term "washing machine" preferably includes an automatic washing machine and/or a combination device such as a washer-dryer.

An embodiment of the invention is shown in the drawings in a purely schematic manner and will be described in more detail below.

DETAILED DESCRIPTION OF THE DRAWING

Figure 1:
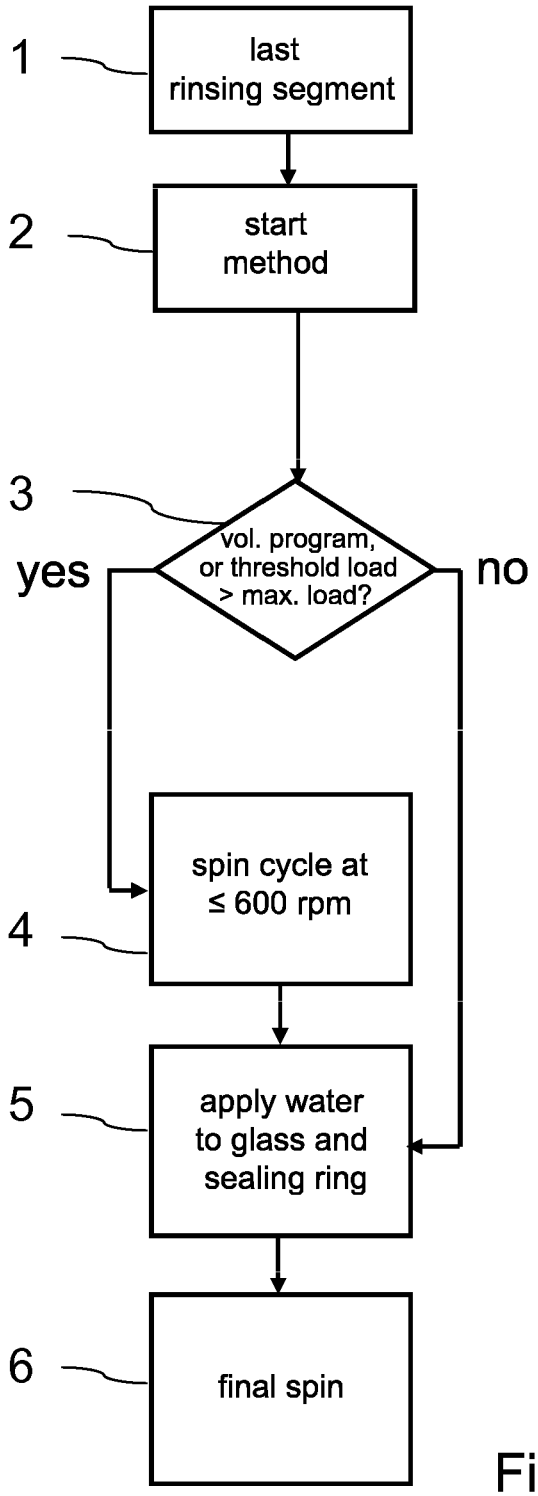
FIG. 1 shows a flowchart of a method according to the invention.

FIG. 1 schematically shows a flow chart of a method according to the invention. In step 1, a last rinsing segment of a rinsing phase of a selected washing program is carried out. Step 1 is followed by step 2, in which the method according to the invention starts. Step 2 is followed by step 3, which comprises determining whether the washing program has a threshold load amount that exceeds a predetermined maximum load amount, for example 2 kg, and/or is a voluminous laundry washing program. If yes, i.e., if it is determined that the washing program has a threshold load amount that exceeds the predetermined maximum load amount and/or is a voluminous laundry washing program, then step 3 is followed by step 4, which involves performing a spin cycle having a maximum rotational speed of 600 rpm, and step 4 is followed by step 5.

If it is determined in step 3 that the washing program has a threshold load amount that is less than or equal to the predetermined maximum loading amount and a washing program that is different from any voluminous laundry washing program, then step 5 directly follows step 3. Step 5 comprises applying water to a door inspection glass and a door sealing ring of a washing machine in order to rinse them, with a drum of the washing machine being at a standstill while the water is being applied to the door inspection glass and/or the door sealing ring. Step 5 is followed by step 6, which comprises a final spin. During the final spin, to drain the laundry in the drum, the drum is rotated at a higher rotational speed than step 4, in which the laundry rests on a wall of the drum, and the water from the laundry from the fabric is thrown through openings in the drum due to centrifugal force in the suds container.

Figure 2:
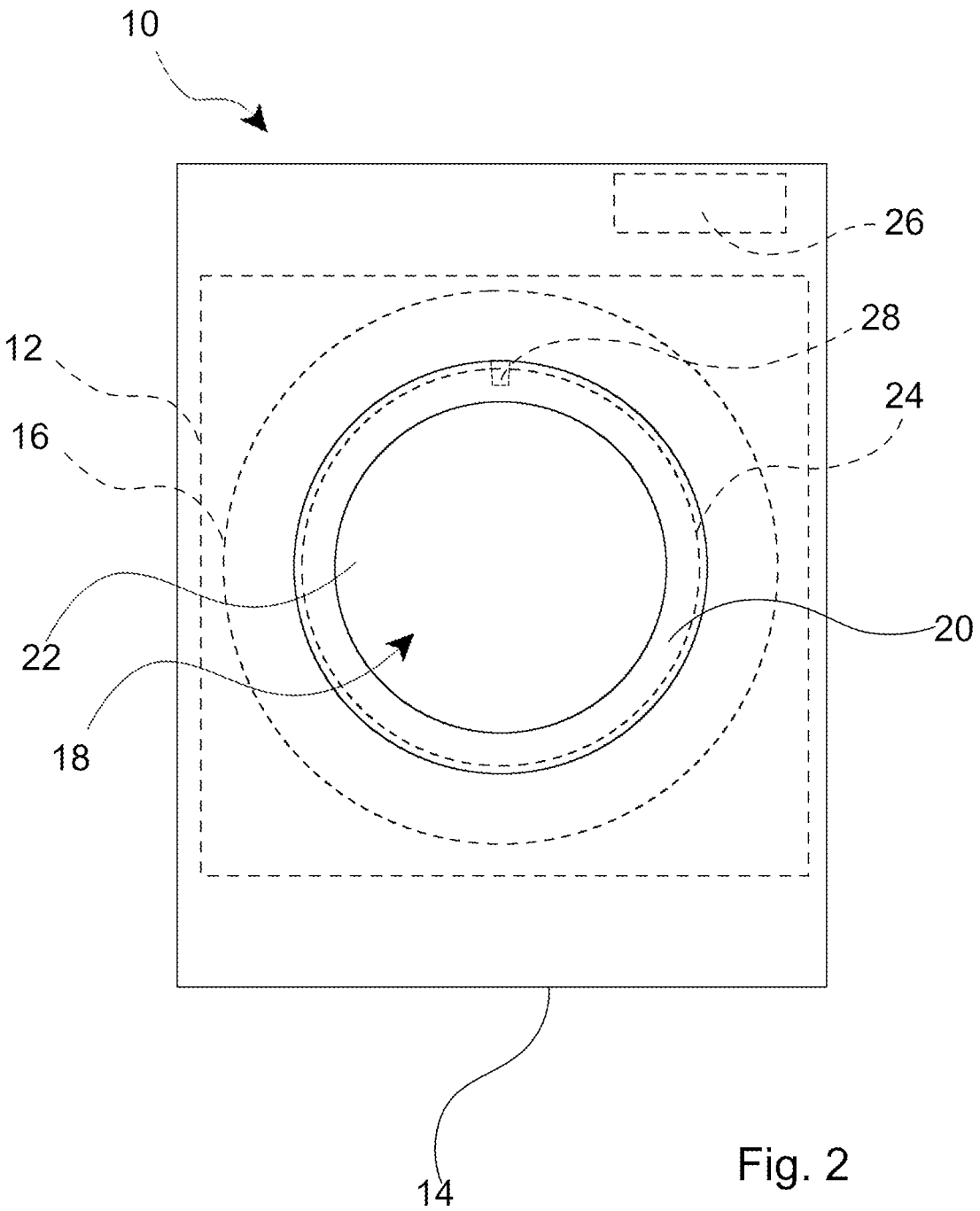
FIG. 2 schematically shows a washing machine for performing the method.

FIG. 2 shows a washing machine 10 having a suds container 12 arranged in a housing 14, in which container a drum 16 is rotatably mounted, a loading opening 18 arranged at the front of the housing 14 which can be closed by means of a door 20 having a door inspection glass 22, a door sealing ring 24 which extends between the housing 14 and the suds container 12 around the loading opening 18, and a control or regulating device 26 that is designed to control or regulate a method according to one or a plurality of the described embodiments.

Furthermore, the washing machine 10 preferably has a door inspection glass flusher 28. The door inspection glass flusher 28 is preferably provided in and/or on the door sealing ring. For example, the door inspection glass flusher 28 is an injection device such as a nozzle and/or an opening in a door sealing ring 24 designed as a bellows seal or as an elastic sleeve.

The washing machine 10 can be a washing machine used in a private household or commercially.

The invention claimed is:

1. A method for operating a washing machine having a suds container arranged in a housing, in which container a drum is rotatably mounted, a loading opening arranged on the front of the housing, which can be closed by means of a door having a door inspection glass, a door sealing ring which extends between the housing and the suds container around the loading opening, and a control or regulating device, wherein the method comprises the following steps:

carrying out a selected washing program which comprises a rinsing phase and in which water is applied to the door inspection glass and the door sealing ring following the rinsing phase, in order to rinse the door inspection glass and the door sealing ring, and performing a spin cycle at a maximum rotational speed as a function of the selected washing program after the rinsing phase and before applying the water to the door inspection glass and the door sealing ring, the spin cycle completing before applying the water to the door inspection glass and door sealing ring.

2. The method according to claim 1, further comprising the following steps:

determining whether the selected washing program has a threshold load amount that exceeds a predetermined maximum load amount or is a voluminous laundry washing program and wherein the function of the selected washing program to carry out the step of performing the spin cycle after the rinsing phase and before applying the water to the door inspection glass and the door sealing ring at the maximum rotational speed, is the function of whether the washing program has the threshold load amount that exceeds the predetermined maximum load amount or whether the washing program is the voluminous laundry washing program.

3. The method according to claim 2, wherein, upon determining that the washing program has a threshold load amount that is equal to or less than the predetermined maximum loading amount and is a washing program that is different from the voluminous laundry washing program, applying the water to the door inspection glass and the door sealing ring immediately after the rinsing phase to rinse the door inspection glass and the door sealing ring, and, upon determining that the washing program has a threshold load amount that exceeds the predetermined maximum load amount or that the washing program is the voluminous laundry washing program, carrying out the spin cycle at the maximum rotational speed following the rinsing phase and then applying the water to the door inspection glass and the door sealing ring, in order to rinse the door inspection glass and the door sealing ring.

4. The method according to claim 1, further comprising the steps of:

sensing a load amount of laundry in the drum in an initial phase of the washing program, and performing a linear or step-by-step adjustment of the maximum rotational speed during the spin cycle as a function of the sensed load amount.

5. The method according to claim 1, further comprising the steps of:

sensing foam in the drum following the rinsing phase, and performing a linear or step-by-step adjustment of the maximum rotational speed during the spinning process as a function of the sensed foam.

6. The method according to claim 1, wherein the drum is at a standstill while the water is applied to the door inspection glass and the door sealing ring.

7. The method according to claim 1, further comprising the following step:

continuously activating a drain device for conducting the water out of the suds container at least during the spinning process at the maximum rotational speed or during the application of the water to the door inspection glass and the door sealing ring.

8. The method according to claim 1, further comprising the following steps:

sensing a pressure in the suds container after the rinsing phase, and activating a drain device for conducting the water out of the suds container at least during the spinning process at the maximum rotational speed or during the application of the water to the door inspection glass and the door sealing ring upon determining that the pressure sensed in the suds container is greater than a predetermined threshold.

9. The method according to claim 1, wherein an amount of the water applied to the door inspection glass and the door sealing ring to rinse the door inspection glass and the door sealing ring corresponds to a predetermined amount of water, which depends on at least one of the following parameters:

the selected washing program, a sensed load amount, sensed foam, an amount of an automatically dosed detergent which is fed to the suds container during the washing program.

10. A washing machine having a suds container arranged in a housing, in which container a drum is rotatably mounted, a loading opening arranged at the front of the housing that can be closed by means of a door having a door inspection glass, a door sealing ring that extends between the housing and the suds container around the loading opening, and an electronic control or regulating device that is programmed to cause the washing machine to perform the following method steps:

carrying out a selected washing program which comprises a rinsing phase and in which water is applied to the door inspection glass and the door sealing ring following the rinsing phase, in order to rinse the door inspection glass and the door sealing ring, and performing a spin cycle after the rinsing phase and before applying the water to the door inspection glass and the door sealing ring at a maximum rotational speed as a function of the selected washing program, the spin cycle completing before applying the water to the door inspection glass and door sealing ring.

* * * * *